United States Patent [19]

Imai et al.

[11] 3,955,274

[45] May 11, 1976

[54] METHOD OF MANUFACTURING A LOW ENERGY-LOSS WAVEGUIDE CIRCUIT ELEMENT

[75] Inventors: Kuninori Imai, Kanagawa; Akihiko Higurashi, Tokyo, both of Japan

[73] Assignees: Hitachi Electronics, Ltd.; Hitachi, Ltd., both of Japan

[22] Filed: Dec. 30, 1974

[21] Appl. No.: 537,951

Related U.S. Application Data

[63] Continuation-in-part of Ser. No. 327,161, Jan. 26, 1973, abandoned.

[30] Foreign Application Priority Data

| | | |
|---|---|---|
| Aug. 25, 1972 | Japan | 47-84534 |
| Jan. 24, 1973 | United Kingdom | 3663/73 |
| Jan. 23, 1973 | Germany | 2303184 |
| Jan. 25, 1973 | France | 73.02684 |

[52] U.S. Cl. ..... 29/600; 72/258

[51] Int. Cl.[2] ..... H01P 11/00

[58] Field of Search ..... 72/258, 267; 29/600, 29/470.1, 475, 471.1; 333/95, 96, 97, 98

[56] References Cited

UNITED STATES PATENTS

| | | | |
|---|---|---|---|
| 1,948,242 | 2/1934 | Schubarth | 72/258 |
| 2,945,293 | 7/1960 | Last | 29/470.1 |
| 3,149,415 | 9/1964 | Hyver | 29/470.1 |
| 3,184,945 | 5/1965 | Hornak et al. | 72/258 |
| 3,566,316 | 2/1971 | Sawada et al. | 29/600 |
| 3,648,351 | 3/1972 | Kibler | 72/258 |

*Primary Examiner*—C. W. Lanham
*Assistant Examiner*—James R. Duzan
*Attorney, Agent, or Firm*—Craig & Antonelli

[57] ABSTRACT

A method of manufacturing low energy-loss waveguide circuit elements in which a film of metal with low resistivity is laid on the surface of a base metal and a hard metal die of a desired shape is pressed into the base metal through the metal film, so that a plastic strain is caused in the base metal thereby to form a recessed portion in the base metal, while at the same time welding the metal film to the base metal to cover the internal surface of the recessed portion with the metal film.

5 Claims, 7 Drawing Figures

METHOD OF MANUFACTURING A LOW ENERGY-LOSS WAVEGUIDE CIRCUIT ELEMENT

CROSS-REFERENCE TO RELATED APPLICATION

This is a continuation-in-part of application Ser. No. 327,161 filed on Jan. 26, 1973, now abandoned.

BACKGROUND OF THE INVENTION

1. Field of the Invention

This invention relates to an improvement of a method for manufacturing a waveguide circuit element for use in ultrashort wave band.

2. DESCRIPTION OF THE PRIOR ART

In a waveguide circuit element for ultrashort wave bands, it is generally required to minimize the electric loss on the internal surface of a recessed portion of the waveguide circuit element which constitute a conductive surface for transmission of electric waves.

For this purpose, it is of primary importance to process the internal surface of the recessed portion to a great degree of accuracy in the manufacture of the circuit element in order to achieve a minimum electric loss. In processing of the internal surface or electric wave conductive surface of the recessed portion, therefore, it is desirable that the dimensional accuracy of the recessed portion be improved to the order of several microns, that the internal surface be mirror-finished so that the difference in height between the highest and lowest portions of the surface be not more than 0.2 microns except for abnormally high or low portions, and that the internal surface of the recessed portion be made of a metal of as low resistivity as practicable.

In conventional methods of manufacturing a waveguide circuit element with such a recessed portion, the conductive internal surface of the recessed portion is formed either by (1) hollowing out the base metal of copper, phosphor bronze, brass or the like on a machine such as a lathe to form a recess and then effecting an electroplating to coat the internal surface of the recessed portion with a metal of a low resistivity such as silver thereby to form a conductive surface for electric waves, or (2) by effecting a copper electroforming on a metal core of aluminum or the like of a shape similar to the recess and, after extracting it, effecting an electroplating to cost the internal surface of the recessed portion with a metal of a low resistivity thereby to form a transmission surface for electric waves.

Since the above-mentioned conventional methods involve the difficult process of the electroplating for obtaining the conductive surface, the thickness of the deposited metal often varies from point to point on the internal surface of the recessed portion, and accordingly a uniform dimensional accuracy cannot be obtained, which makes it difficult to finish the conductive surface in the dimensional accuracy and mirror-finish described above. Further, the metal deposited on the internal surface of the recessed portion by the electroplating has many defects, resulting in an increased resistivity of the conductive surface for electric waves. In addition, the manufacturing processes are so complicated that the production cost is higher.

As mentioned above, the conventional method of manufacturing waveguide circuit elements with a recessed portion has the disadvantage of low dimensional accuracy and high roughness and resistivity of the internal surface or the conductive surface of the recessed portion, resulting in a high electric loss. Thus, according to the conventional method, it is difficult to manufacture waveguide circuit elements having a conductive surface of a low electric energy-loss.

SUMMARY OF THE INVENTION

It is an object of the present invention to provide a unique method of manufacturing a waveguide circuit element having an electric wave conductive surface with a low electric energy loss.

DESCRIPTION OF THE PREFERRED EMBODIMENT

Figure 1:
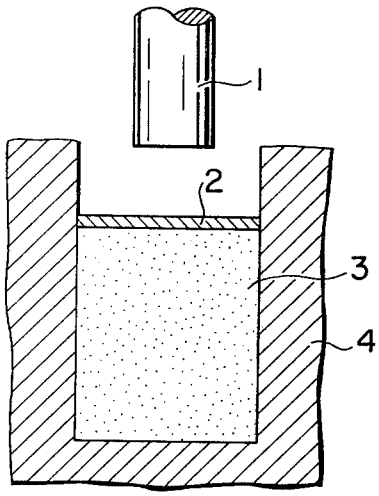
FIG. 1 is a diagram of a longitudinal sectional view for explaining the method of manufacture of a waveguide circuit element with a recessed portion according to the present invention.

The method of the present invention will be now explained in detail with reference to an embodiment. Referring to FIG. 1, the reference numeral 1 shows a hard male die of a desired shape, the numeral 2 a film of conductive metal of a low resistivity such as gold or silver, and the numeral 3 a base metal of copper or the like, and the numeral 4 a female die.

First, oxides and oily materials attached to the upper surface of the base metal 3 and the lower surface of the metal film 2 are cleaned off by appropriate means, and both of the surfaces are laid one on the other in the female die 4. The male die 1 of a hard metal such as steel is pressed into the base metal 3 through the metal film 2. A plastic strain is thus caused in the base metal 3 and as a result a recessed portion with its internal surface covered with the metal film 2 is formed. The male die 1 has a shape similar to that desired for the internal conductive surface of the recessed portion as far as possible so far as it is extractable from the recessed portion. The internal surface is made up identically in shape with the male die 1 and constituting a conductive surface for electric waves. In the process, if the flow stress of the metal film 2 is substantially equal to or lower than that of the base metal 3, and the ratio of the former to the latter is not more than 1.5 (in other words, the ratio of the flow stress of the base metal to that of the metal film 2/3), the metal film 2 laid on the base metal 3 is extended over the internal surface of the formed recessed portion with a uniform thickness without being torn off, and at the same time the metal film 2 and the base metal 3 are welded with each other into an integral member.

Figure 3:
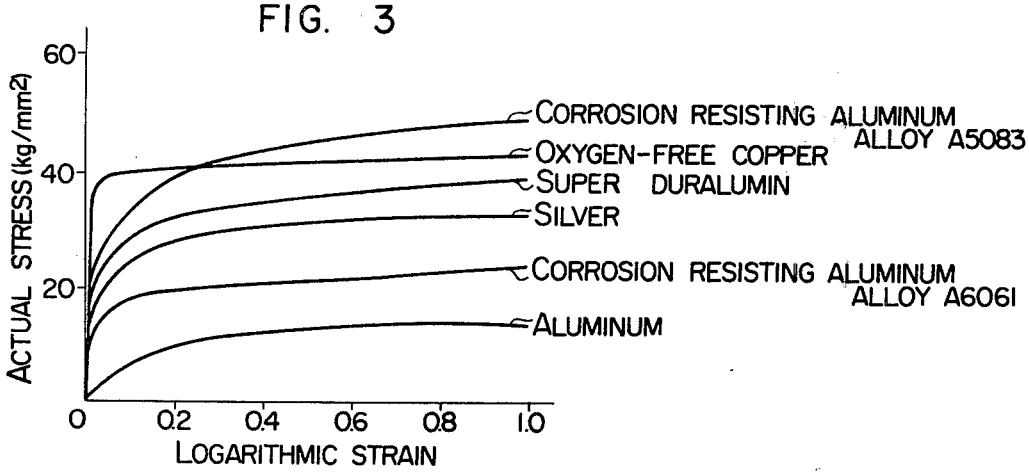
FIG. 3 is a graph showing flow stresses of various kind of materials for a base metal and silver for a metal film.
Figure 4:
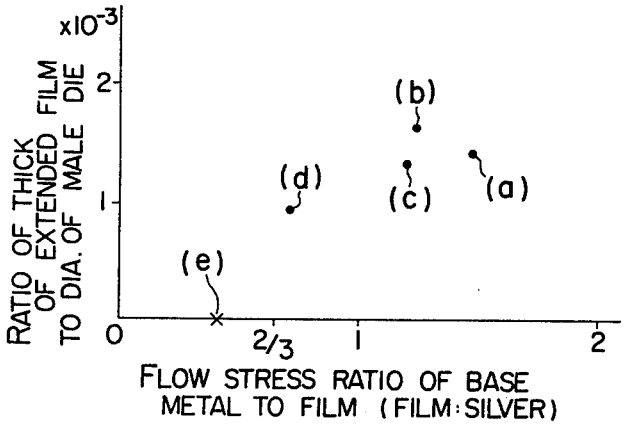
FIG. 4 is a graph showing state of the extended silver film on the internal surface of the recessed portion for the individual base metal materials shown in FIG. 3.

FIG. 3 shows flow stresses of various kind of materials considered in use for the base metal 3 in comparison with silver which can be used for the metal film 2. The ordinate of FIG. 3 indicates actual stress applied to the materials in a compression test thereof, and the abscissa indicates logarithmic strain in the material, which is expressed by log $e$ $(ho/h)$ where $ho$ and $h$ designate heights of a test sample of the material before and after the compression test, respectively. As can be seen from this Figure, the flow stress of silver is higher than 1.5 times that of aluminum while it is not higher than 1.5 times those of the other materials. An experiment was made in which silver was used for the material of the metal film 2 and aluminum, corrosion resisting aluminum aloy A6061, super duralumin A7075, oxygen-free copper, and corrosion resisting aluminum aloy A5083 were used for the material of the base metal 3, and in which a cylindrical male die was used as the male die 1. FIG. 4 shows the thickness of the extended silver film on the internal surface of the recessed portion in relation with the ratio of the flow stress of the base metal to that of the metal film. In this Figure, the ordinate indicates the ratio of the thickness of the extended silver film to the diameter of the male die while the abscissa indicates the ratio of the flow stress of the base metal to that of the metal film. As can be seen from FIG. 4, when aluminum was used for the base metal, i.e, in case the ratio of the flow stress of the base metal to that of the metal film is smaller than 2/3, the metal film (silver film) was torn off, while when the other metals, corrosion resisting aluminum aloy A6061, supper duralumin A7075, oxygenfree copper, and corrosion resisting aluminum aloy A5083 were used for the base metal, i.e. in case the ratio of the flow stress of the base metal to that of the metal film is larger than 2/3, the metal film (silver film) was extended uniformly on the internal surface of the recessed portion without being torn off.

Figure 5:
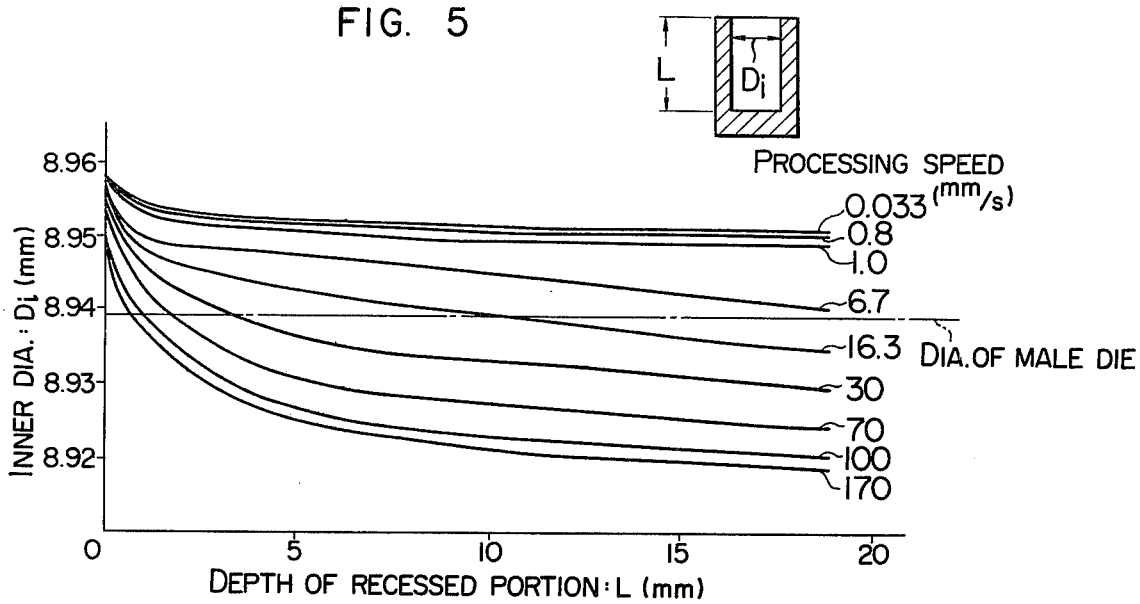
FIG. 5 is a graph showing variation, in the axial direction, in the inner diameter of the recessed portion in relation with various processing speeds at which a male die is pressed into the base metal.
Figure 6:
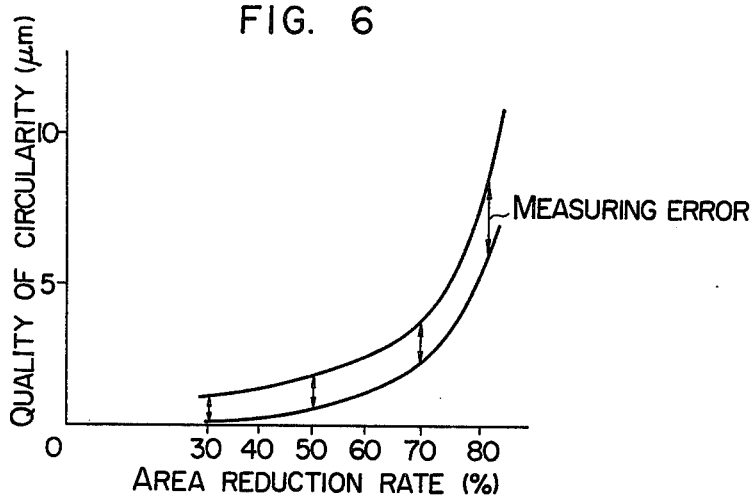
FIG. 6 is a graph showing quality of circularity of the recessed portion in relation with area reduction rate.

The internal surface of the recessed portion is the electric wave conductive surface which requires a high dimensional accuracy and high surface precision, and therefore it is necessary to properly determine the processing speed at which the male die 1 is pressed into the base metal 3 and the area reduction rate which is indicated by the ratio of the cross-sectional area of the male die 1 to the surface area of the base metal 3. Namely, when the processing speed is high, the recessed portion is deformed in the axial direction and the dimensional accuracy becomes deteriorated. This can be seen from FIG. 5. FIG. 5 shows variation, in the axial direction, in the inner diameter of the recessed portion formed at various processing speeds. As can be seen from this Figure, the processing speed of not higher than about 1 mm/sec is preferable for obtaining a high dimensional accuracy such that the dimensional error of the internal surface of the recessed portion is maintained within several microns required for the electric wave conductive surface. Further, when the area reduction rate is large, and about 80% or larger, the side wall of the recessed portion becomes thin and the shape of the recessed portion is easily deformed, so that the quality of circularity of the recess becomes deteriorated. FIG. 6 shows this fact. In FIG. 6, the ordinate indicates the quality of circularity of the recess, while the abscissa indicates the area reduction rate. The quality of circularity is expressed by the maximum inner diameter minus the minimum inner diameter. As can be seen from FIG. 6, the area reduction rate is to be determined to 70% or smaller, and preferably it is 30% or smaller, which is attained by a hobbing process.

In order to attain a high surface precision, i.e. a mirror-finishing of the internal surface such as mentioned above, the application of plastic strain is carried out by a cold processing. This is because such mirror-finishing cannot be attained by a hot processing, since in a hot processing an oxide film is easily caused on the surface of a processed metal and particles of processed metal material become large so that the surface precision becomes inferior. Thus, it is preferable for attaining a high dimensional accuracy and high surface precision that the application of plastic strain is carried out by a cold hobbing processing.

In this way, a surface of a low resistivity for transmission of electric waves is formed in the recessed portion of the base metal 3, producing a desirable waveguide circuit element.

The thickness of the metal film 2 to be laid on the base metal 3 is determined in dependence upon the employed material of the metal film and the required thickness of the extended film layer formed on the internal surface of the recessed portion. For example, when a male die 3 to 8 mm in diameter is pressed into the base metal of copper 10 mm in diameter through the metal film of silver 0.2 to 1 mm thick which is laid on the base metal, a silver layer several microns to 20 microns thick is formed on the internal surface of the recessed portion.

The measure for the above surface cleaning and lubrication during the male die is pressed into the base metal are in no way fixed but variable as occasion demands.

Figure 2:
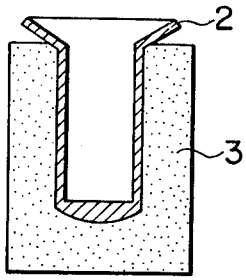
FIG. 2 is a diagram of a longitudinal sectional view of the waveguide circuit element as it has been processed according to the method of the invention.

The evenness of the internal surface of the recessed portion of the waveguide circuit element thus obtained is equal to or only slightly inferior to that of the male die 1, and therefore it is possible to obtain a sufficiently mirror-finished internal surface of the recessed portion by finishing the male die satisfactorily in advance, with the result that the difference in height between the highest and lowest portions of the surface excepting an abnormally high or low point is maintained at 0.2 micron or less (for example, 0.02 micron). Also, the dimensional error of the internal surface of the recessed portion as against the male die is controlled at the order of several microns, thereby providing a method superior to the conventional ones. Further, the portion of the metal film that is not in contact with the male die in the process of manufacture is left out of contact in the shape of a bell as shown in FIG. 2, so that the method according to the present invention makes it possible to easily recollect the valuable metal such as gold or silver and effectively use such metal.

Furthermore, according to the method of the invention, the provision of only one set of a male die and a female die permits a great number of waveguide circuit elements high and uniform in quality to be produced very easily, and a reduced number of manufacturing processes.

Figure 7:
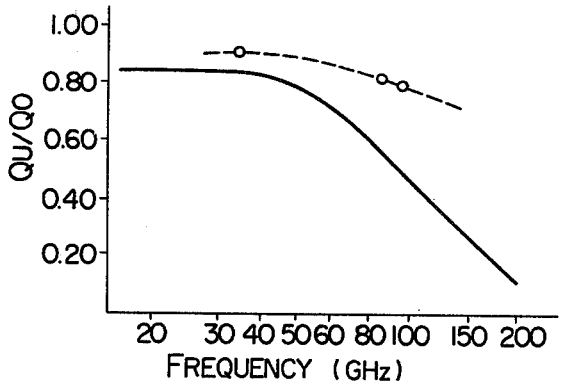
FIG. 7 is a diagram showing the electric characteristic of a cavity resonator to which the waveguide circuit element manufactured by the method of the present invention is applied.

Illustrated in FIG. 7 is an electric characteristic of the waveguide circuit element for ultrashort wave band manufactured according to the method of the invention as it is applied to a cavity resonator. In this figure, the abscissa is representative of the frequencies of electric waves passing the conductive surface or the internal surface of the cavity resonator, while the ordinate shows the $Qu/Qo$ value of the cavity resonator, the symbols $Qu$ and $Qo$ respectively denoting actual and theoretical quality factors of the cavity resonator. The solid line shows the characteristic of a conventional cavity resonator of this type, while the white circles connected by the dashed line indicate the $Qu/Qo$ values of the cavity resonator manufactured by the method of the invention at the frequencies of 35 GHz, 84.5 GHz and 96.3 GHz respectively. As is apparent from the drawing, the $Qu/Qo$ values are considerably higher in the cavity resonator according to the invention than in the cavity resonator manufactured by the conventional methods.

Even though the above explanation was made with reference to the manufacture of a waveguide circuit element for ultrashort wave band, it is needless to say that the method of the present invention is also applicable to a member material with a recessed portion such as for other types of resonators, circulator and the like, as well as member materials with a recessed portion in general which require a high dimensional or surface accuracy for the internal surface of the recessed portion.

A similar method may be considered, in which the metal film 2 is joined to the base metal 3 by thermal pressing or electroplating and the male die 1 is pressed into the base metal 3 through the metal film 2. In such method, however, when the joining is made by thermal pressing a complicated pre-treating is involved. Namely, cleaning the surfaces of the metal film 2 and base metal 3 and then thermally pressing them in an inert atmosphere are necessitated. This complicated pretreating results in a high manufacturing cost. When the joining is made by electric plating a simple pretreating can be made. However, it is necessary to perform an electroplating such as provides a sufficient thickness of the metal film 2. This is because a thin thickness of the metal film 2 cannot provide a satisfactory thickness, necessary for a waveguide circuit element, of the surface layer formed of the metal film 2 in the internal surface of the recessed portion of the fabricated waveguide circuit element. A thin surface layer also leads to degradation in corrosionresistivity. The necessity of thick electroplating thickness also results in a high manufacturing cost.

It will be seen from the above description that the method of manufacturing a waveguide circuit element according to the present invention has a number of advantages over the prior art, including the simplicity of the manufacturing processes and therefore a high practical value.

We claim:

1. A method of manufacturing a waveguide circuit element comprising the steps of:

preparing a low resistivity metal film and a base metal, wherein the ratio of the flow stress of the film metal to that of the base metal is not more than 1.5, each of said low resistivity metal film and said base metal having at least one major surface, cleaning the respective major surfaces of said low resistivity metal film and said base metal, overlaying in a die cavity of a female die said low resistivity metal film on said base metal with said respective cleaned major surface in facing relationship, and forming a conductive internal surface inside a recessed portion within said base metal by pressing a male die of a desired shape into said base metal through said low resistivity metal film by cold processing at a low processing speed of not higher than 1 mm/sec. and an area reduction rate of not larger than 70% so as to cause a plastic strain in the base metal, said recessed portion being formed with a thick side wall, said conductive internal surface of said recessed portion being formed of a uniform thin layer of said low resistivity metal film, and said conductive internal surface being formed with a surface finish wherein the difference in height between the highest and lowest points of said surface is not more than 0.2 $\mu$m such that said internal surface of said recessed portion constitutes a conductive surface for transmission of electric waves.

2. A method of manufacturing a waveguide circuit element according to Claim 1, in which said area reduction rate is not larger than 30%.

3. A method of manufacturing a waveguide circuit element according to Claim 1, in which said low resistivity metal film is a material selected from the group consisting of silver and gold.

4. A method of manufacturing a waveguide circuit element according to Claim 1, in which said low resistivity metal film is silver, and wherein said base metal is a material selected from the group consisting of corrosion resisting aluminum alloy A 6061, super duralumin A 7075, oxygen-free copper, and corrosion resisting aluminum alloy A 5083.

5. A method of manufacturing a waveguide circuit element according to Claim 1, wherein said surface finish having the difference in height between the highest and lowest points of not more than 0.2 $\mu$m is formed over a substantial portion of the entire conductive internal surface except for randomly occurring abnormally high or low points.

* * * * *